US007172023B2

(12) United States Patent
Barker et al.

(10) Patent No.: US 7,172,023 B2
(45) Date of Patent: Feb. 6, 2007

(54) PERFORATING GUN ASSEMBLY AND METHOD FOR ENHANCING PERFORATION DEPTH

(75) Inventors: James M. Barker, Mansfield, TX (US); Michael C. Rogers, Basingstoke (GB); Duncan MacNiven, Portlethen (GB)

(73) Assignees: Delphian Technologies, Ltd., Aberdeen (GB); Well Ballistics, Ltd., Hampshire (GB); Halliburton Energy Services Inc., Dallas, TX (US)

( * ) Notice: Subject to any disclaimer, the term of this patent is extended or adjusted under 35 U.S.C. 154(b) by 153 days.

(21) Appl. No.: 10/793,202

(22) Filed: Mar. 4, 2004

(65) Prior Publication Data

US 2005/0194181 A1 Sep. 8, 2005

(51) Int. Cl.
*E21B 43/116* (2006.01)

(52) U.S. Cl. ..... 166/297; 166/55; 175/4.55; 102/310

(58) Field of Classification Search ..... 166/297, 166/298, 55; 175/4.51, 4.55; 102/310
See application file for complete search history.

(56) References Cited

U.S. PATENT DOCUMENTS

| | | | | |
|---|---|---|---|---|
| 2,928,658 A | | 3/1960 | Miner | |
| 2,976,940 A | * | 3/1961 | Surbatovich | 175/4 |
| 3,043,379 A | | 7/1962 | Porter et al. | |
| 3,089,416 A | | 5/1963 | Gilbert | |
| 3,329,219 A | * | 7/1967 | Pausky | 175/4.55 |
| 3,347,314 A | | 10/1967 | Schuster | |
| 3,380,540 A | * | 4/1968 | Fields | 175/4.55 |
| 3,630,282 A | | 12/1971 | Lanmon, II | |
| 3,695,368 A | | 10/1972 | Lanmon, II | |
| 4,105,073 A | | 8/1978 | Brieger et al. | |
| 4,140,188 A | | 2/1979 | Vann | |
| 4,193,460 A | | 3/1980 | Gilbert | |
| 4,519,313 A | | 5/1985 | Leidel | |
| 4,527,636 A | * | 7/1985 | Bordon | 175/4.55 |
| 4,756,371 A | | 7/1988 | Brieger et al. | |
| 4,844,170 A | | 7/1989 | Gill | |
| 4,960,171 A | | 10/1990 | Parrott et al. | |
| 5,054,564 A | | 10/1991 | Oestreich et al. | |
| 5,323,684 A | | 6/1994 | Umphries | |
| 5,392,857 A | | 2/1995 | Behrmann | |
| 5,673,760 A | | 10/1997 | Brooks et al. | |
| 6,014,933 A | | 1/2000 | Umphries et al. | |
| 6,347,673 B1 | | 2/2002 | Dailey | |
| 6,397,947 B1 | | 6/2002 | Behrmann et al. | |
| 6,494,139 B1 | | 12/2002 | Powell | |
| 6,523,449 B2 | | 2/2003 | Fayard et al. | |

* cited by examiner

*Primary Examiner*—Jennifer H. Gay
*Assistant Examiner*—Daniel P Stephenson
(74) *Attorney, Agent, or Firm*—Danamraj & Youst, P.C.; Richard A. Fagin

(57) ABSTRACT

A perforating gun assembly (110) for creating communication paths for fluid between a formation (114) and a cased wellbore (116) includes a housing, a detonator and a detonating cord (136). The perforating gun assembly (110) includes one or more substantially axially oriented collections of shaped charges (122, 124, 126) each of which is operably associated with the detonating cord (136). A perforation (152, 154) is formed in the formation (114) as a result of the interaction of jets (141, 142) formed upon the detonation of at least two shaped charges (122, 126) that create a weakened region (148) in the formation (114) followed by the detonation of at least one shaped charge (124) that forms a jet (150) that penetrated through the weakened region (148).

24 Claims, 5 Drawing Sheets

PERFORATING GUN ASSEMBLY AND METHOD FOR ENHANCING PERFORATION DEPTH

TECHNICAL FIELD OF THE INVENTION

This invention relates, in general, to perforating a cased wellbore that traverses a subterranean hydrocarbon bearing formation and, in particular, to a perforating gun assembly having collections of shaped charges that are detonated to discharge jets that interact together to enhance perforation depth.

BACKGROUND OF THE INVENTION

Without limiting the scope of the present invention, its background will be described with reference to perforating a subterranean formation with a perforating gun assembly, as an example.

After drilling a section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more charge carriers are loaded with shaped charges that are connected with a detonator via a detonating cord. The charge carriers are then connected within a tool string that is lowered into the cased wellbore at the end of a tubing string, wireline, slick line, electric line, coil tubing or other conveyance. Once the charge carriers are properly positioned in the wellbore such that the shaped charges are adjacent to the interval to be perforated, the shaped charges may be fired. Upon detonation, each shaped charge generates a high-pressure stream of metallic particles in the form of a jet that penetrates through the casing, the cement and into the formation.

The goal of the perforation process is to create openings through the casing to form a path for the effective communication of fluids between the reservoir and the wellbore. It has been found, however, that a variety of factors associated with the perforating process can significantly influence the productivity of the well. For example, during the drilling phase of well construction, drilling mud particles build up a filter cake on the side of the wellbore. While the filter cake prevents additional leaching of drilling mud into the reservoir, this filtrate may impair production from the reservoir. Accordingly, effective perforations must not only be formed through the casing and cement, but also through this filter cake and into virgin rock.

As another example, the pressure condition within the wellbore during the perforation process has a significant impact on the efficiency of the perforations. Specifically, perforating may be performed in an overbalanced or underbalanced pressure regime. Perforating overbalanced involves creating the opening through the casing under conditions in which the hydrostatic pressure inside the casing is greater than the reservoir pressure. Overbalanced perforating has the tendency to allow the wellbore fluid to flow into the reservoir formation. Perforating underbalanced involves creating the opening through the casing under conditions in which the hydrostatic pressure inside the casing is less than the reservoir pressure. Underbalanced perforating has the tendency to allow the reservoir fluid to flow into the wellbore. It is generally preferable to perform underbalanced perforating as the influx of reservoir fluid into the wellbore tends to clean up the perforation tunnels and increase the depth of the clear tunnel of the perforation.

It has been found, however, that even when perforating is performed underbalanced, the effective diameter of the perforation tunnels is small as the jet of metallic particles that creates the perforation tunnels is highly concentrated. Due to the small diameter of the perforation tunnels, the volume of the perforation tunnels is also small. In addition, it has been found that even when perforating is performed underbalanced, the surface of the perforation tunnels has reduced permeability compared to the virgin rock. Further, it has been found that the depth of the perforation tunnels is relatively shallow due to the rock structure of the formation.

Therefore a need has arisen for a perforating gun assembly having shaped charges that produce jets that are capable of penetrating through the casing, the cement, the filter cake and into the virgin rock of the reservoir formation. A need has also arisen for such a perforating gun assembly that is not limited to creating small volume perforation tunnels behind the casing. Additionally, a need has arisen for such a perforating gun assembly that is not limited to creating perforation tunnels having a surface with reduced permeability compared to the virgin rock. Further, a need has arisen for such a perforating gun assembly that is not limited to creating relatively shallow perforation tunnels due to the rock structure of the formation.

SUMMARY OF THE INVENTION

The present invention disclosed herein comprises a perforating gun assembly having shaped charges that produce jets that are capable of penetrating through the casing, the cement, the filter cake and into the virgin rock of the reservoir formation. In addition, the perforating gun assembly of present invention is not limited to creating small volume perforation tunnels behind the casing. Further, the perforating gun assembly of present invention is not limited to creating perforation tunnels having a surface with reduced permeability compared to the virgin rock. Also, the perforating gun assembly of present invention is not limited to creating relatively shallow perforation tunnels due to the rock structure of the formation.

The perforating gun assembly of the present invention comprises a housing, at least one detonator positioned within the housing, at least one detonating cord operably associated with the at least one detonator and a plurality of shaped charges forming a substantially axially oriented collection. The shaped charges are operably associated with the at least one detonating cord. During operation, a first portion of the shaped charges in the collection is detonated such that at least two jets are formed that interact to create a weakened region in the formation. The shaped charges of first portion of the shaped charges may be detonated sequentially or substantially simultaneously. In either case, after a predetermined period of delay, a second portion of the shaped charges in the collection is detonated such that at least one jet is formed that penetrates through the weakened region. The interaction of the jets of the first portion of the shaped charges allows for enhanced penetration by the jet of the second portion of shaped charges as the jet of the second portion of shaped charges travels through the weakened region, thereby creating a large volume perforation cavity and tunnel deep into the formation.

In one embodiment, the first portion of the shaped charges includes two outer shaped charges and the second portion of the shaped charges includes a center shaped charge that is positioned between the two outer shaped charges. In addition, attenuating barriers are positioned between the center shaped charge and each of the two outer shaped charges. In this embodiment, the center shaped charge may be oriented substantially perpendicular to an axis of the housing and the two outer shaped charges may be oriented to converge toward the center shaped charge. For example, the two outer shaped charges may converge toward the center shaped charge at an angle between about 1 degree and about 45 degrees.

In another embodiment, the jets formed upon detonating the shaped charges in the collection are directed substantially toward a focal point. In this embodiment, the jets formed from the first portion of the shaped charges may progress to a location short of the focal point and the jet formed from the second portion of the shaped charges may progress to a location past the focal point. Alternatively, the jets formed from the first portion of the shaped charges may intersect at the focal point and the jet formed from the second portion of the shaped charges may progress to a location past the focal point.

The perforating gun assembly of the present invention may include a plurality of collections of shaped charges. In this case, each collection of shaped charges in the plurality of collections of shaped charges may be circumferentially phased relative to adjacent collections of shaped charges. For example, adjacent collections of shaped charges may be circumferentially phased at an angle of between about 15 degrees and about 180 degrees.

In another aspect, the present invention comprises a method that includes positioning a perforating gun assembly within the wellbore casing, the perforating gun assembly including a plurality of shaped charges that form a collection, detonating a first portion of the shaped charges in the collection to form jets that interact with one another to creating a weakened region in the formation and detonating a second portion of the shaped charges in the collection to form at least one jet that penetrates through the weakened region, thereby creating the perforation in the formation. The method may be performed in an underbalanced pressure condition or when an underbalanced pressure condition does not exist. The method may also include performing a treatment operation following detonation the shaped charges.

In a further aspect, the present invention comprises a completion that includes a subterranean formation, a wellbore that traverses the formation and a casing disposed within the wellbore, wherein the formation has a perforation formed therein as a result of an interaction of jets formed upon the detonation of at least two shaped charges that create a weakened region in the formation followed by the detonation of at least one shaped charge forming a jet that penetrated through the weakened region.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
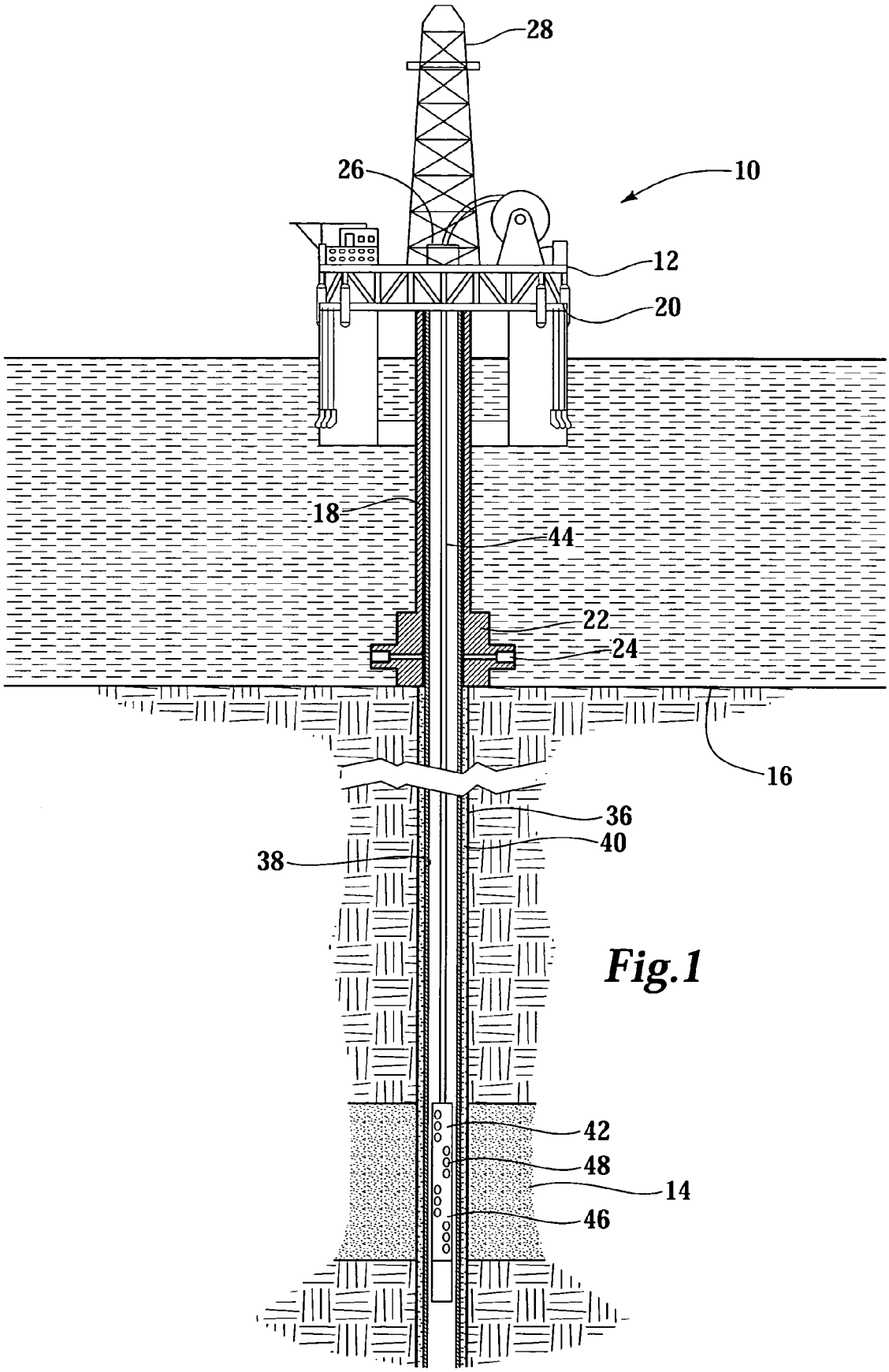
FIG. 1 is schematic illustration of an offshore oil and gas platform operating a perforating gun assembly of the present invention.

Referring initially to FIG. 1, a perforating gun assembly adapted for use in a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings.

A wellbore 36 extends through the various earth strata including formation 14. Casing 38 is cemented within wellbore 36 by cement 40. When it is desired to perforate casing 38 adjacent to formation 14, a perforating gun assembly 42 is lowered into casing 38 via conveyance 44 such as a wireline, electric line, coiled tubing, jointed tubing or the like. Perforating gun assembly 42 includes a housing 46 which encloses one or more detonators and associated detonating cords as well as a plurality of shaped charges. The shaped charges are axially and circumferentially oriented behind scallops 48 in housing 46 which are areas of housing 46 having a reduced thickness. As illustrated, scallops 48 are formed in groups of three axially oriented scallops with adjacent groups of scallops being circumferentially phased. Alternatively, housing 46 may include a series of ports having port plugs positioned therein instead of scallops 48.

Once perforating gun assembly 42 is positioned adjacent to formation 14, an electric or other triggering signal is sent to the detonator or detonators which initiates the detonation of the shaped charges that are disposed within perforating gun assembly 42. Upon detonation, each of the shaped charges generates a high-pressure stream of metallic particles in the form of a jet that penetrates casing 38, cement 40 and into formation 14. In the present invention, certain of the jets interaction with one another such that perforation cavities and tunnels are created in formation 14 that are large and deep regions of high permeability surrounding wellbore 36 that significantly enhance the productivity of the well.

Even though FIG. 1 depicts a vertical well, it should be noted by one skilled in the art that the perforating gun assembly of the present invention is equally well-suited for use in wells having other geometries such as deviated wells, inclined wells or horizontal wells. Accordingly, use of directional terms such as up, down, above, below, upper, lower and the like are with reference to the illustrated embodiments in the figures. Also, even though FIG. 1 depicts an offshore operation, it should be noted by one skilled in the art that the perforating gun assembly of the present invention is equally well-suited for use in onshore operations. Additionally, even though FIG. 1 depicts a single perforating gun assembly, the principles of the present invention are applicable to gun systems utilizing strings of perforating gun assemblies as well as gun systems utilizing select fire techniques.

Figure 2:
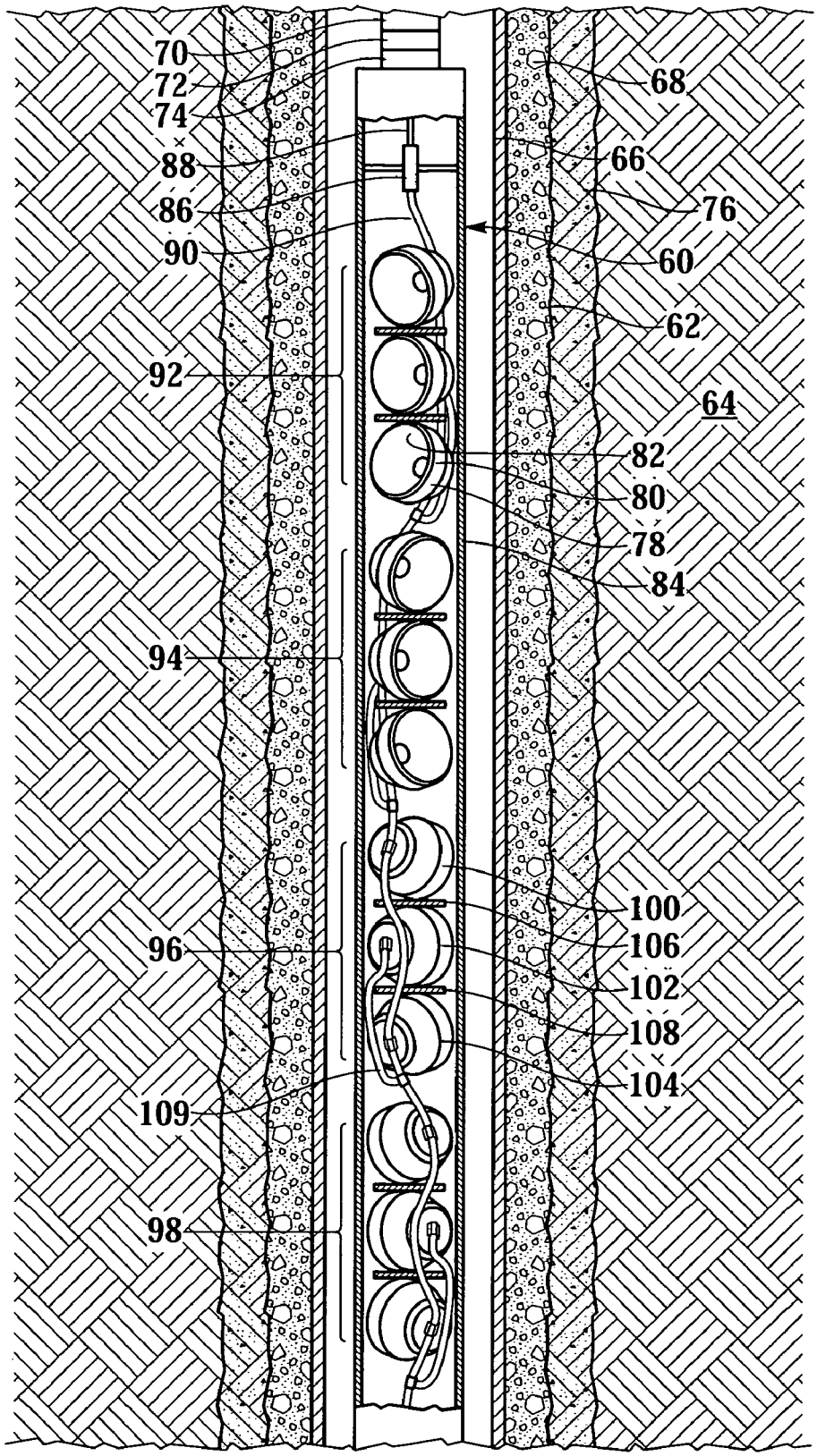
FIG. 2 is a cross sectional view of a perforating gun assembly of the present invention positioned within a wellbore.

Referring now to FIG. 2, therein is depicted a perforating gun assembly 60 positioned in a wellbore 62 that traverses formation 64. A casing 66 lines wellbore 62 and is secured in position by cement 68. A conveyance 70 is coupled to perforating gun assembly 60 at a cable head 72. A collar locator 74 is positioned below cable head 72 to aid in the positioning of perforating gun assembly 60 in wellbore 62. As noted above, during the drilling phase of well construction, a drilling mud is used to contain formation pressure. Accordingly, the hydrostatic pressure of the drilling mud exceeds the reservoir pressure causing portions of the drilling mud to leach into formation 64. As part of this leaching process, a filter cake 76 builds up near the surface of wellbore 64 which helps to prevent additional leaching but may impair production from formation 64.

A fluid such as drilling fluid (not shown) fills the annular region between perforating gun assembly 60 and casing 66. In the illustrated embodiment, perforating gun assembly 60 includes a plurality of shaped charges, such as shaped charge 78. Each of the shaped charges includes an outer housing, such as housing 80 of shaped charge 78, and a liner, such as liner 82 of shaped charge 78. Disposed between each housing and liner is a quantity of high explosive. The shaped charges are retained within a charge carrier housing 84 by a support member (not pictured) that maintains the shaped charges in the unique orientation of the present invention.

Disposed within housing 84 is a detonator 86 that is coupled to an electrical energy source via electrical wire 88. Detonator 86 may be any type of detonator that is suitable for initiating a detonation in a detonating cord as the present invention is detonator independent, such detonators being of the type that are well known in the art or subsequently discovered. Detonator 86 is coupled to a detonating cord 90, such as a primacord. Detonating cord 90 is operably coupled to the initiation ends of the shaped charges allowing detonating cord 90 to initiate the high explosive within the shaped charges through, for example, an aperture defined at the apex of the housings of the shaped charges. In the illustrated embodiment, once detonator 86 is operated, the detonation will propagate down detonating cord 90 to sequentially detonate the shaped charges in a timed sequence that progresses substantially from the top to the bottom of perforating gun assembly 60.

In the illustrated embodiment, perforating gun assembly 60 includes a plurality of collections of shaped charges, four such collections being shown namely collections 92, 94, 96, 98. Each collection 92, 94, 96, 98 includes three individual shaped charges such as shaped charges 100, 102, 104 of collection 96. The shaped charges within each collection 92, 94, 96, 98 are positioned axially relative to one another such that the shaped charges within each collection 92, 94, 96, 98 generally point in the same circumferential direction of housing 84. Accordingly, as used herein the term axially oriented will be used to describe the relationship of shaped charges within a collection of shaped charges wherein adjacent shaped charges are generally axially displaced from one another and generally point in the same circumferential direction.

In the illustrated embodiment, the shaped charges within each collection 92, 94, 96, 98 are oriented to converge toward one another. For example, collection 94 includes, outer shaped charge 100, center shaped charge 102 and outer shaped charge 104. Center shaped charge 102 is oriented substantially perpendicular to the axis of housing 84. Outer shaped charges 100, 104 are oriented to converge toward center shaped charge 102. In one preferred orientation, the angle of convergence between adjacent shaped charges in each collection 92, 94, 96, 98 is between about 5 degrees and about 10 degrees. Other preferred orientations include angles of convergence between about 1 degree and about 45 degrees. It should be noted that the desired angle of convergence for a particular perforating gun assembly being used to perforate a particular wellbore will be dependent on a variety of factors including the size of the shaped charges, the diameter of the perforating gun assembly and wellbore casing, the expected depth of penetration into the formation and the like.

In the illustrated embodiment, the shaped charges in adjacent collections are circumferentially phased relative to one another. Specifically, the shaped charges in collection 92 are circumferentially phased ninety degrees from the shaped charges in collection 94. Likewise, the shaped charges in collection 94 are circumferentially phased ninety degrees from the shaped charges in collection 96, the shaped charges in collection 96 are circumferentially phased ninety degrees from the shaped charges in collection 98 and the shaped charges in collection 98 are circumferentially phased ninety degrees from the shaped charges in the next adjacent collection (not pictured) which are circumferentially aligned with the shaped charges in collection 92. Importantly, other circumferential phasing increments may be desirable when using the perforating gun assembly of the present invention, such other circumferential phasing increments being within the scope of the present invention. Specifically, circumferential phasing in increments of between about 15 degrees and about 180 degrees are suitable for use in the present invention.

Positioned between adjacent shaped charges within each collection 92, 94, 96, 98 is an attenuating barrier such as attenuating barrier 106 between shaped charges 100, 102 and attenuating barrier 108 between shaped charges 102, 104. The attenuating barriers are used to prevent fragments of the outer two shaped charges in each collection 92, 94, 96, 98 from interfering with the jet development of the center shaped charge in each collection 92, 94, 96, 98 as the firing of the center shaped charge occurs after the firing of the outer two shaped charges in the preferred firing sequence. In the illustrated embodiment, the firing sequence of each collection 92, 94, 96, 98 is the upper shaped charge, the lower shaped charge then the center shaped charge.

For example, as the detonation progresses down detonating cord 90 and arrives at collection 96, shaped charge 100 is initiated first, followed by the initiation of shaped charge 104. The detonation then progresses both further down detonation cord 90 toward collection 98 and within feedback leg 109 of detonating cord 90. Feedback leg 109 is operably coupled to shaped charge 102 such that shaped charge 102 is initiated after shaped charge 104. The amount of delay between the initiation of shaped charge 104 and shaped charge 102 may be determined based upon the length of feedback leg 109. As shaped charge 102 is initiated after shaped charges 100, 104, attenuating barriers 106, 108 prevent fragments of shaped charges 100, 104 from interfering with the jet development of shaped charge 102. It should be noted by those skilled in the art that other firing sequences could alternatively be used without departing from the principles of the present invention. As one alternative, the outer two shaped charges in each collection 92, 94, 96, 98 could be simultaneously fired followed by the initiation of the center shaped charge. This type of sequencing can be achieved using, for example, multiple detonators, multiple detonating cords, electrical timing devices or the like. As another alternative, a substantially bottom up sequence could be used.

Even though FIG. 2 has depicted all of the shaped charges as having a uniform size, it should be understood by those skilled in the art that it may be desirable to have different sized shaped charges within a collection such as having larger or smaller outer shaped charges than the center shaped charge. Also, even though FIG. 2 has depicted attenuating barriers between adjacent shaped charges within each collection, attenuating barriers could also be used between shaped charges in adjacent collections if desired.

Figure 3:
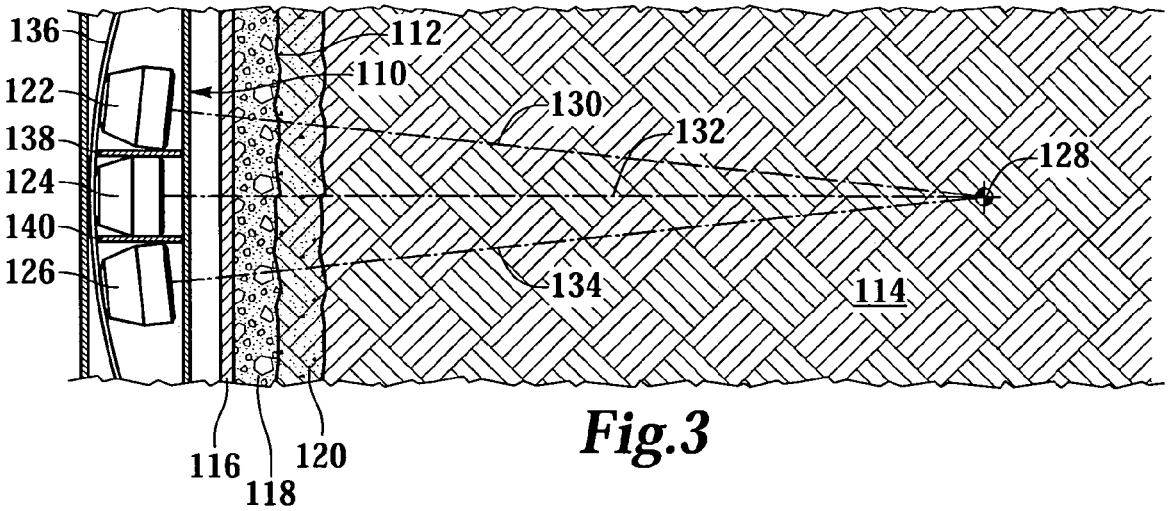
FIG. 3 is a cross sectional view of a collection of shaped charges disposed within a perforating gun assembly of the present invention positioned within a wellbore before detonation.

Referring next to FIG. 3, therein is depicted a portion of a perforating gun assembly 110 positioned in a wellbore 112 that traverses formation 114. A casing 116 lines wellbore 112 and is secured in position by cement 118. Wellbore 112 includes a filter cake 120 near the surface of wellbore 112. The portion of perforating gun assembly 110 shown includes a substantially axially oriented collection of shaped charges 122, 124, 126. In the illustrated embodiment, shaped charges 122, 124, 126 are oriented to converge toward one another. Specifically, center shaped charge 124 is oriented substantially perpendicular to the axis of perforating gun assembly 110 while outer shaped charges 122, 126 are oriented to converge toward center shaped charge 124. More specifically, shaped charges 122, 124, 126 are each oriented toward a focal point 128 in formation 114 as indicated by dashed lines 130, 132, 134, respectively. One or more detonating cords 136 are operably coupled to shaped charges 122, 124, 126 such that shaped charges 122, 126 are fired substantially simultaneously followed by the firing of shaped charge 124. To protect shaped charge 124 during the firing of shaped charges 122, 126, attenuating barriers 138, 140 are positioned respectively between shaped charges 122, 124 and shaped charges 124, 126.

Figure 4:
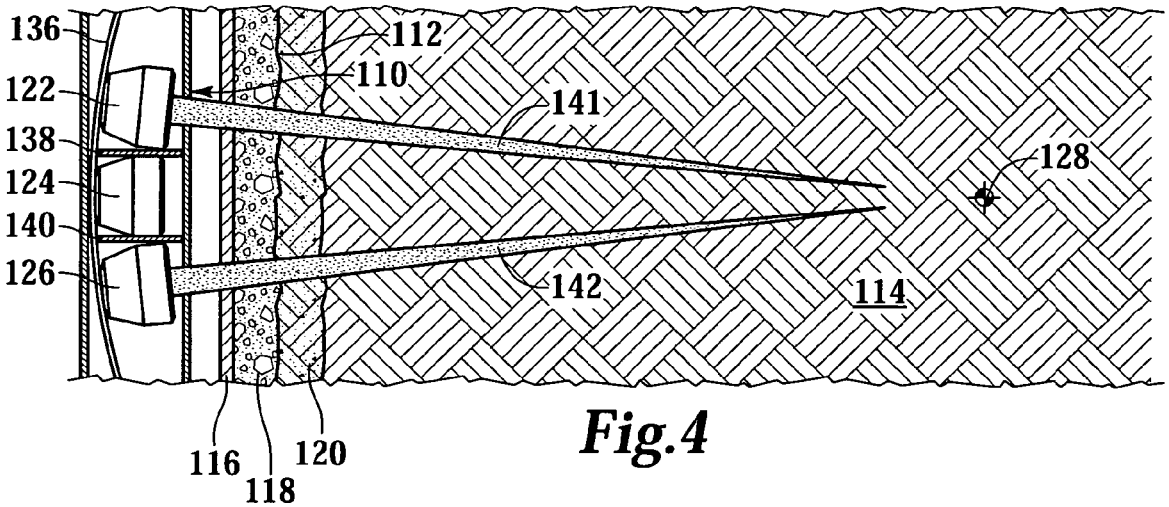
FIG. 4 is a cross sectional view of a formation upon the detonation of the outer two shaped charges of a collection of shaped charges of the present invention.
Figure 5:
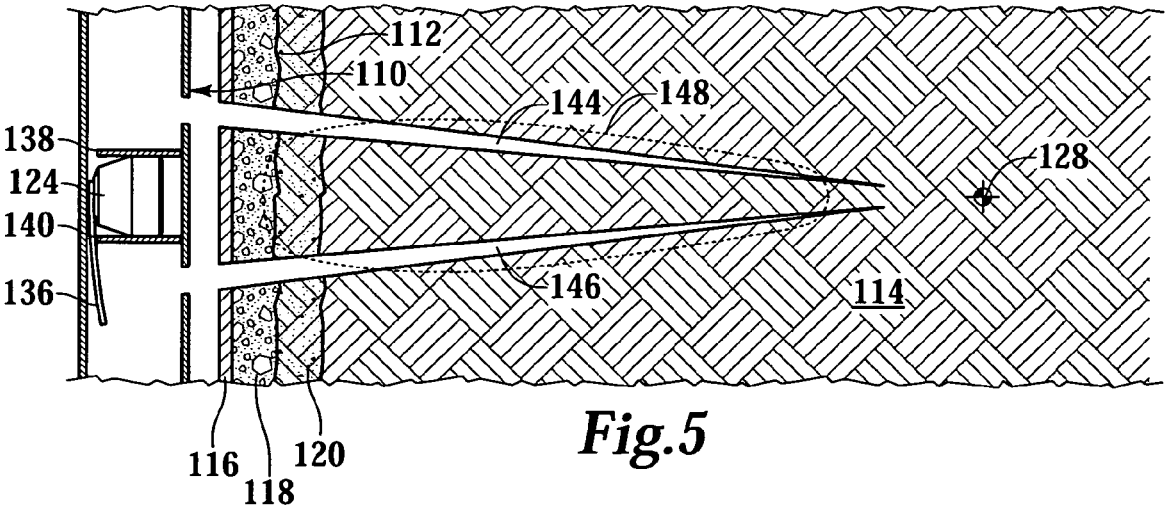
FIG. 5 is a cross sectional view of a formation following the detonation of the collection of shaped charges of the present invention indicating a pulverized zone.
Figure 6:
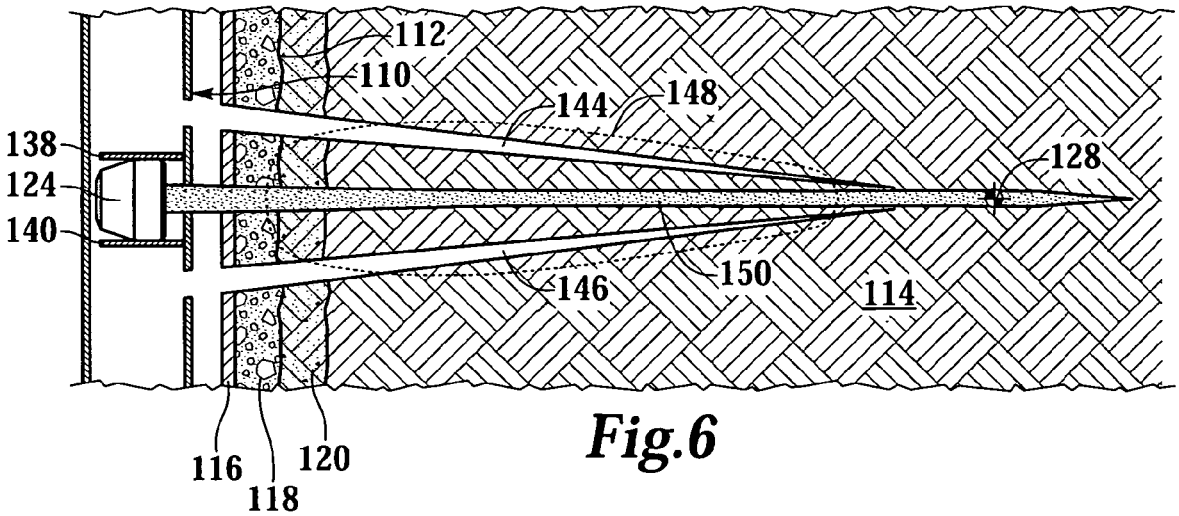
FIG. 6 is a cross sectional view of a formation upon the detonation of a center shaped charge of a collection of shaped charges of the present invention.

As best seen in FIG. 4, when shaped charges 122, 126 are detonated, shaped charge 122 discharges jet 141 and shaped charge 126 discharges jet 142, both of which are directed toward focal point 128. In the illustrated embodiment, jets 141, 142 do not reach focal point 128 and do not intersect. Nonetheless, as best seen in FIG. 5, jets 141, 142 interact together within formation 114. Specifically, jets 141, 142 not only create perforation tunnels 144, 146 respectively, but also create a weakened region or pulverized zone represented by dotted line 148 in formation 114. The interaction of jets 141, 142 substantially rubblizes, pulverizes or otherwise breaks down or fragments the structure of the rock in pulverized zone 148. Accordingly, as best seen in FIG. 6, when shaped charge 124 is detonated after a predetermined delay period, shaped charge 124 discharges jet 150 which are directed toward focal point 128. In the illustrated embodiment, jets 150 penetrates pulverized zone 148 and progresses past focal point 128 due to the reduced resistance to the propagation of jet 150 created in pulverized zone 140 as compared to virgin rock.

Figure 7:
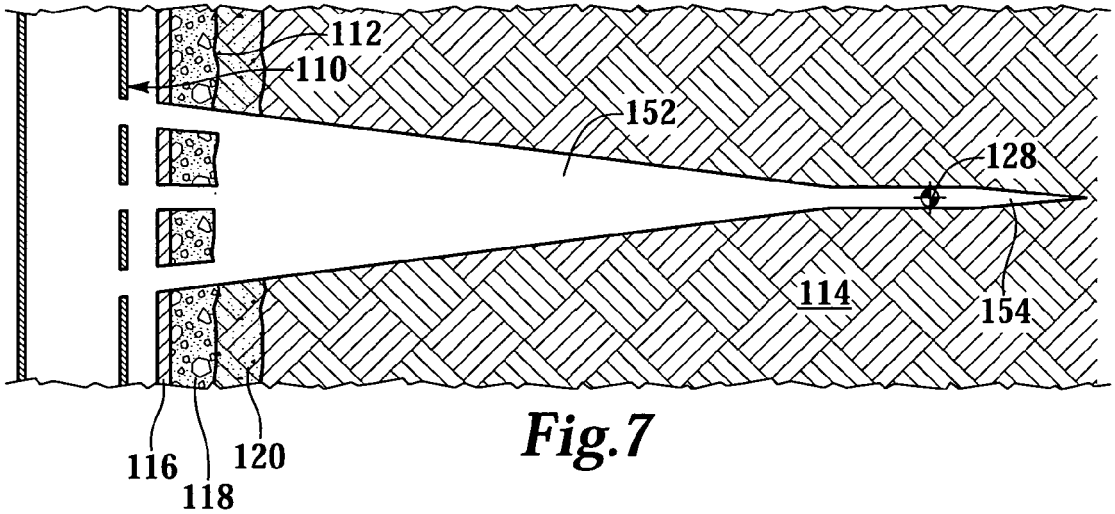
FIG. 7 is a cross sectional view of a formation following the detonation of a collection of shaped charges of the present invention depicting the resulting perforation cavity and tunnel.

As best seen in FIG. 7, due to the interaction of jets 141, 142 forming pulverized zone 148 and the resulting enhanced penetration of jet 150, a perforation cavity 152 having a perforation tunnel 154 extending outwardly therefrom is created in formation 114 behind casing 116 having a depth and a volume significantly larger than that of conventional perforation tunnels. Using the present invention to create combination perforation cavities and tunnels, such as perforation cavity 152 and perforation tunnel 154, establishes large volume regions deep into the formation having high permeability into which formation fluid drain, increasing the productivity of a well as compared to wells having only conventional perforation tunnels. In addition, the need to perforate underbalanced is reduced by the use of the present invention as perforation cavity 152 and perforation tunnel 154 are not as easily plugged by debris or rock structure as are conventional perforation tunnels. As discussed below, however, operating the present invention in underbalanced pressure conditions will aid in cleaning up perforation cavity 152 and perforation tunnel 154 and further increase the volume and clear depth of perforation cavity 152 and perforation tunnel 154.

Even though FIGS. 3–7 have depicted a substantially axially oriented collection of three shaped charges that are oriented to converge toward a focal point in the formation wherein the outer two shaped charges form jets that interact but do not reach the focal point and do not intersect, the present invention is not limited to such a configuration. For example, the outer two shaped charges in a collection of shaped charges could alternatively form jets that penetrate through the casing, the cement, the filter cake and into the formation past a focal point such that the jets intersect substantially at the focal point. The interaction of the jets in this case also substantially rubblizes, pulverizes or otherwise breaks down or fragments the structure of the rock behind the casing such that enhanced penetration can be achieved by the jet formed upon firing the center shaped charge, thereby creating a perforation cavity and perforation tunnel as described above with reference to FIG. 7.

It should be understood by those skilled in the art that while the preceding figures have depicted each of the shaped charges with a collection of shaped charges as being oriented toward a focal point, this configuration is not required by the present invention. For example, some of the shaped charges in a collection of shaped charges may be directed toward one location in the formation while other of the shaped charges in the same collection may be directed toward another location in the formation. As another example, there may be some circumferential offset or phasing between adjacent shaped charges in an axially oriented collection of shaped charges. In either of these configurations, the jets generated from certain of the shaped charges in the collection are able to interact such that the jets formed by subsequently fired shaped charges pass through a pulverized zone, thereby enhancing penetration depth and creating a perforation cavity and perforation tunnel of the present invention.

Use of the perforating gun assembly of the present invention enables the creation of large volume perforation cavities and tunnels with deep penetration into the formation behind the casing that enhances the productivity of a well when compared to a conventionally perforating system that creates small volume, shallow perforation tunnels. Nonetheless, following the creation of the perforation cavities and tunnels of the present invention, it may be desirable to stimulate or otherwise treat the producing interval. Treatment processes such as gravel packs, frac packs, fracture stimulations, acid treatments and the like may be preformed. In fact, the perforation cavities and tunnels of the present invention allow for improved sand control as the sand, gravel, proppants or the like used in gravel pack and frac pack slurries fills the perforation cavities and tunnels, thereby preventing the migration of formation fines into the wellbore. Additionally, the perforation cavities and tunnels of the present invention help to enhance the propagation of fractures deep into the formation during frac pack and fracture stimulation operations.

In tests comparing conventional perforating systems with the perforating gun assembly of the present invention, significant volumetric and depth of penetration differences between conventional perforation tunnels and the perforation cavities and tunnels of the present invention have been shown. Tests were performed using 3⅜ inch Millennium 25 g HMX shaped charges fired through a 0.5 inch 4140 steel plate, 0.75 inches of cement and into a confined 60 mD Berea Sandstone target.

TABLE 1

| | Single Charge | Three Charge Collection |
|---|---|---|
| Entrance Hole (in) | 0.35 | 2.25 × 0.5 |
| Penetration Depth (in) | 13.22 | 13.51 |
| Clear Depth (in) | 10.12 | 11.15 |
| Hole Volume ($in^3$) | 0.6 | 6.43 |
| Cleaned Up Volume ($in^3$) | 3.80 | 11.63 |

Table 1 shows that the use of a collection of three shaped charges that are oriented to converge toward one another and that are sequentially fired such that the outer two shaped charges form jets that interact together to create a pulverized zone through which the jet of the center shaped charge is fired, create a perforation cavity and tunnel having a depth and volume that is significant larger than conventional perforation tunnels. Specifically, the entrance hole into the target created by the conventional single charge was 0.35 inches in diameter while the entrance hole created by the three-charge collection had a height of 2.25 inches and a width of 0.5 inches. The depth of penetration into the target for the conventional single charge was 13.22 inches and for the three-charge collection was 13.51 inches with the clear depth for the conventional single charge being 10.12 inches and for the three-charge collection being 11.15 inches.

Figure 8:
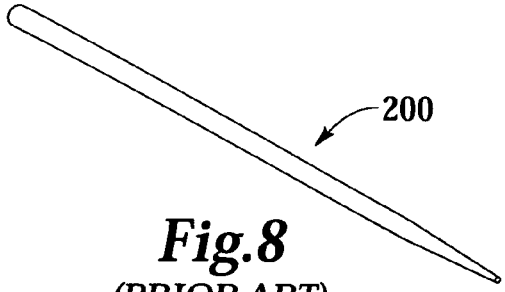
Fig.8 (PRIOR ART)
FIG. 8 is a prior art drawing of a volumetric representation of a perforation tunnel.
Figure 9:
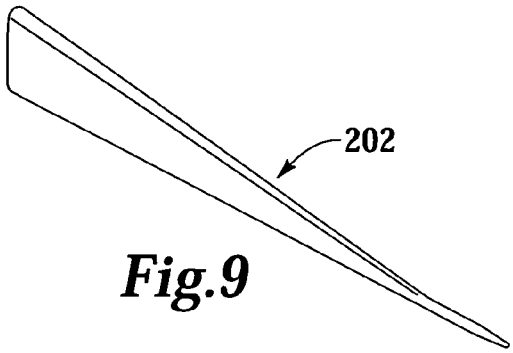
FIG. 9 is a volumetric representation of a perforation cavity and tunnel of the present invention.

The hole volume for the conventional single charge was only 0.6 cubic inches while the hole volume for the three-charge collection was 6.43 cubic inches. FIG. 8 depicts a volumetric representation designated 200 of the 0.6 cubic inch perforation tunnel created by the conventional single charge. FIG. 9 depicts a volumetric representation designated 202 of the 6.43 cubic inch perforation cavity and tunnel created by the three charge collection. As should be appreciated by those skilled in the art, the volume of perforation cavity and tunnel 202 is more than ten times greater than the volume of perforation tunnel 200 and the clear depth of perforation cavity and tunnel 202 is more than ten percent greater than the clear depth of perforation tunnel 200.

Figure 10:
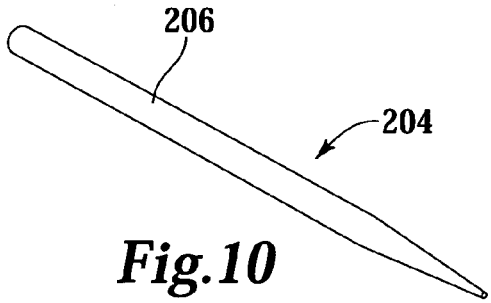
Fig.10 (PRIOR ART)
FIG. 10 is a prior art drawing of a volumetric representation of a perforation tunnel following complete clean up.
Figure 11:
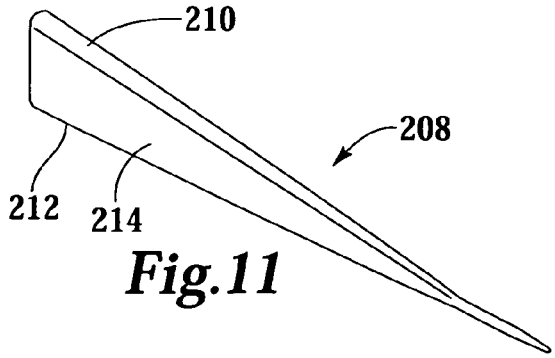
FIG. 11 is a volumetric representation of a perforation cavity and tunnel of the present invention following complete clean up.

FIG. 10 depicts a volumetric representation designated 204 of a 3.80 cubic inch perforation tunnel created by the conventional single charge under simulated underbalanced conditions to completely clean up perforation tunnel 200 of FIG. 8. Likewise, FIG. 11 depicts a volumetric representation designated 208 of an 11.63 cubic inch perforation cavity and tunnel created by the three charge collection under simulated underbalanced conditions to completely clean up perforation cavity and tunnel 202 of FIG. 9. After clean up, the volume of perforation cavity 208 is more than three times greater than the volume of perforation tunnel 204.

Importantly, as noted above, even after complete clean up, conventional perforation tunnels have a skin or region near the surface with reduced permeability as compared to the permeability of virgin rock. This skin surrounds the entire perforation tunnel and reduces the productivity of the well. In FIG. 10, the affected surface of perforation tunnel 204 has been designated 206. Unlike conventional perforation tunnels, the perforation cavities and tunnels of the present invention are not surrounded by a reduced permeability skin. Instead, the perforation cavity portions of the perforation cavities and tunnels created using the present invention only have a reduced permeability skin at their uppermost and lowermost regions, which have been designated 210, 212 in FIG. 11. The sides portions of the perforation cavity portion, designated 214 in FIG. 11, do not have this reduced permeability skin due in part to tension waves ablating the rock. These tension waves arise from the interaction of compression waves between the tunnels which are created during the formation of the perforation cavity portion. This improved permeability further enhances the productivity of wells having perforation cavities and tunnels created using the perforating gun assembly of the present invention.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A perforating gun assembly, comprising:

a housing;

a detonator disposed within the housing; and at least one collection of shaped charges disposed within the housing and operably associated with the detonator, shaped charges in the at least one collection positioned substantially along a longitudinal axis of the housing, the shaped charges oriented such that jets formed upon detonation of the charges are directed substantially toward a focal point, the shaped charges being operatively associated with a detonation timing delay element configured such that a first portion of the shaped charges detonates first and perforation jets thereof interact to create a weakened region in a formation, the timing delay element configured such that the perforation jets of a second portion of the shaped charges detonated after a predetermined delay penetrate the weakened region.

2. The perforating gun assembly of claim 1 wherein at least one of the shaped charges provides a jet that progresses past the focal point.

3. The perforating gun assembly of claim 1 further comprising a plurality of collections of shaped charges disposed at axially spaced apart locations within the housing, each of the plurality of collections operably associated with the detonator, shaped charges in each collection positioned substantially along a longitudinal axis of the housing, the shaped charges in each collection oriented such that jets formed upon detonation of the charges are directed substantially toward a focal point associated with each collection.

4. The perforating gun assembly of claim 3 wherein each of the collections is circumferentially phased with respect to an adjacent one of the collections.

5. The perforating gun assembly of claim 4 wherein the circumferential phasing between adjacent collections is between about 15 and 180 degrees.

6. The perforating gun assembly of claim 1 wherein the at least one collection comprises three shaped charges.

7. The perforating gun assembly of claim 1 wherein the at least one collection comprises a centrally positioned shaped charge oriented substantially perpendicular to the longitudinal axis and one shaped charge on either side of the centrally positioned shaped charge, the shaped charges on either side oriented such that their jets are substantially directed at the focal point.

8. The perforating gun assembly of claim 7 wherein the charges on either side converge at an angle of between one and 45 degrees.

9. The perforating gun assembly of claim 1 wherein adjacent ones of the shaped charges converge toward one another at an angle of between one and 45 degrees.

10. The perforating gun assembly of claim 1 wherein the detonator is arranged to detonate the shaped charges at different times.

11. The perforating gun assembly of claim 10, wherein the detonator is arranged to first detonate a first endmost shaped charge in the at least one collection, second to detonate a center shaped charge in the at least one collection and finally to detonate second endmost shaped charge in the at least one collection.

12. A method for perforating a wellbore having a casing therein, comprising:

detonating within the casing at least one collection of shaped charges, the at least one collection positioned substantially along an axis substantially perpendicular to an axis of the wellbore, the shaped charges oriented such that jets formed upon the detonation are directed substantially toward a focal point, the shaped charges having detonation timing selected such that a first portion of the shaped charges detonates first and jets thereof interact to create a weakened region in a formation, a second portion of the shaped charges detonated after a predetermined delay to penetrate the weakened region.

13. The method of claim 12 wherein at least one of the shaped charges provides a jet that progresses past the focal point.

14. The method of claim 12 further comprising detonating a plurality of collections of shaped charges disposed at axially spaced apart locations, shaped charges in each collection positioned substantially along the axis, the shaped charges in each collection oriented such that jets formed upon the detonation of the charges are directed substantially toward a focal point associated with each collection.

15. The method of claim 14 wherein each of the collections is circumferentially phased with respect to an adjacent one of the collections.

16. The method of claim 15 wherein the circumferential phasing between adjacent collections is between about 15 and 180 degrees.

17. The method of claim 12 wherein the detonating is effected by actuating a detonator, the detonator actuating a detonating cord operably disposed between the detonator and the shaped charges.

18. The method of claim 12 wherein the at least one collection comprises three shaped charges.

19. The method of claim 12 wherein the at least one collection comprises a centrally positioned shaped charge oriented substantially perpendicular to the axis and one shaped charge on either side of the centrally positioned shaped charge, the shaped charges on either side oriented such that their jets are substantially directed at the focal point.

20. The method of claim 19 wherein the charges on either side converge at an angle of between one and 45 degrees.

21. The method of claim 12 wherein adjacent ones of the shaped charges converge toward one another at an angle of between one and 45 degrees.

22. The method of claim 12 wherein the detonating is performed when a hydrostatic pressure in the wellbore exceeds a formation fluid pressure.

23. The method of claim 12 wherein the detonating is performed when a hydrostatic pressure in the wellbore is at most equal to a formation fluid pressure.

24. The method of claim 12 further comprising first detonating a first endmost shaped charge in the at least one collection, detonating second a center shaped charge in the at least one collection and detonating last a second endmost shaped charge in the at least one collection.

* * * * *